United States Patent [19]

Burt et al.

[11] Patent Number: 4,808,331

[45] Date of Patent: Feb. 28, 1989

[54] AZEOTROPE OR AZEOTROPE-LIKE COMPOSITION OF 1,1,2,-TRICHLORO-1,2,2-TRIFLUOROETHANE, TRANS-1,2-DICHLOROETHYLENE AND CYCLOPENTANE

[75] Inventors: James G. Burt, Oxford, Pa.; John P. Burns, Claymont, Del.

[73] Assignee: E. I. Du Pont De Nemours and Company, Wilmington, Del.

[21] Appl. No.: 198,022

[22] Filed: May 24, 1988

[51] Int. Cl.[4] ..... C11D 7/30; C11D 7/50

[52] U.S. Cl. ..... 252/172; 252/171; 252/DIG. 9; 134/40

[58] Field of Search ..... 252/171, 172, 153, 162, 252/DIG. 9; 134/12, 38, 39, 40

[56] References Cited

U.S. PATENT DOCUMENTS

| | | | |
|---|---|---|---|
| 2,999,815 | 9/1961 | Eiseman, Jr. | 257/171 |
| 2,999,817 | 9/1961 | Bower | 252/172 |
| 3,349,039 | 10/1967 | Penault | 252/172 |
| 3,455,835 | 7/1969 | Burt | 252/172 |
| 3,903,009 | 9/1975 | Bauer | 257/171 |

*Primary Examiner*—Paul Lieberman
*Assistant Examiner*—Kathleen Markowski
*Attorney, Agent, or Firm*—James E. Shipley

[57] ABSTRACT

An Azeotrope or azeotrope-like composition of 1,1,2-trichloro-1,2,2-trifluoroethane (CFC-113) with trans-1,2-dichloroethylene and cyclopentane useful in solvent cleaning applications.

6 Claims, No Drawings

AZEOTROPE OR AZEOTROPE-LIKE COMPOSITION OF 1,1,2,-TRICHLORO-1,2,2-TRIFLUOROETHANE, TRANS-1,2-DICHLOROETHYLENE AND CYCLOPENTANE

BACKGROUND OF THE INVENTION

As modern electronic circuit boards evolve toward increased circuit and component densities, thorough cleaning of the boards after soldering becomes more important. Current industrial processes for soldering electronic components to circuit boards involve coating the entire circuit side of the board with a flux and thereafter passing this coated side of the board over preheaters and through molten solder. The flux cleans the conductive metal parts and promotes adhesion of the solder. Commonly used fluxes consist, for the most part, of rosin used alone, or with activating additives, such as amine hydrochlorides or oxalic acid derivatives.

The temperatures used during soldering usually thermally degrades part of the flux. The remaining flux and flux residues are often removed from the board with an organic solvent. The requirements for such solvents are stringent: a solvent should have a low boiling point, should be nonflammable, have low toxicity and exhibit high solvent power, so that flux and flux residues can be removed without damage to the substrate being cleaned. Flammability and solvent power characteristics can often be adjusted by preparing solvent mixtures, these mixtures are often unsatisfactory because they fractionate to an undesirable degree during use. Such mixtures also fractionate during recovery, making it difficult to recover a solvent mixture with the original composition.

On the other hand, azeotropic mixtures, with their constant boiling points and constant compositions, have been found to be very useful. Azeotropic mixtures exhibit either a maximum or minimum boiling point and do not fractionate on boiling. These characteristics are also important in the use of the solvent compositions to remove solder fluxes and flux residues from printed circuit boards. Preferential evaporation of the more volatile components of solvent mixtures would occur if the mixtures were not azeotropes or azeotrope-like, and would result in mixtures with changed compositions, with attendant less desirable solvency properties, such as lower rosin flux solvency and lower inertness toward the electrical components being cleaned.

The azeotropic character is also desirable in vapor defluxing operations where redistilled solvent is generally employed for final rinse cleaning. Thus, the vapor defluxing and degreasing systems act as a still. Unless the solvent composition exhibits a constant boiling point, i.e., is an azeotrope or is azeotrope-like, fractionation will occur and undesirable solvent distributions may result to upset the safety and efficacy of the cleaning operation.

A number of chlorofluorocarbon based azeotropic compositions have been discovered and in some cases used as solvents for the removal of solder fluxes and flux residues from printed circuit boards and for miscellaneous degreasing applications. For example, U.S. Pat. No. 3,903,009 discloses the ternary azeotrope of 1,1,2-trichloro-1,2,2-trifluoroethane with nitromethane and ethanol; U.S. Pat. No. 2,999,815 discloses the binary azeotrope of 1,1,2-trichloro-1,2,2-trifluoroethane with acetone; and U.S. Pat. No. 2,999,817 discloses the binary azeotrope of 1,1,2-trichloro-1,2,2-trifluoroethane with methylene chloride. Unfortunately, as recognized in the art, it is not possible to predict the formation of azeotropes and this fact obviously complicates the search for new azeotropic compositions, which have application in the field. Nevertheless, there is a constant effort in the art to discover new azeotropes or azeotrope-like compositions which have desirable solvency characteristics and particularly greater versatilities of solvency power.

SUMMARY OF THE INVENTION

According to the present invention, an azeotrope or azeotrope-like composition has been discovered comprising an admixture of effective amounts of 1,1,2-trichloro-1,2,2-trifluoroethane with trans-1,2-dichloroethylene and cyclopentane, which consists of an admixture of about 56 to 66 weight percent 1,1,2-trichloro-1,2,2-trifluoroethane, 32 to 40 weight percent trans-1,2-dichloroethylene and 1 to 9.5 weight percent cyclopentane.

The present invention provides a nonflammable azeotropic composition which is well suited for solvent cleaning applications.

DETAILED DESCRIPTION OF THE INVENTION

The composition of the instant invention comprises an admixture of effective amounts of 1,1,2-trichloro-1,2,2-trifluoroethane (CCl2FCClF2, boiling point=47.6° C.) with trans-1,2-dichloroethylene (CHCl=CHCl, boiling point=48° C.) and cyclopentane ($C_5H_{10}$, boiling point=50° C.) to form an azeotrope or azeotrope-like mixture. The fluorinated material is known as CFC-113, in the nomenclature conventional to the chlorofluorocarbon field.

By azeotrope or azeotrope-like is meant, a constant boiling liquid admixture of two or more substances which admixture behaves like a single substance, in that the vapor, produced by partial evaporation or distillation of the liquid has the same composition as the liquid, i.e., the admixture distills without substantial change in composition. Constant boiling compositions, which are characterized as azeotropes or azeotrope-like exhibit either a maximum or minimum boiling point, as compared with that of the nonazeotropic mixtures of the same substances.

By effective amount is meant the amount of each component of the instant invention admixture, which when combined, results in the formation of the azeotrope or azeotrope-like composition of the instant invention. It is possible to characterize a constant boiling admixture, which may appear under varying guises, depending upon the conditions choosen, by any of several criteria:

The composition can be defined as an azeotrope of A, B and C, since the very term "azeotrope" is at once both definitive and limitative, requiring that effective amounts of A, B and C form this unique composition of matter, which is a constant boiling admixture.

It is well known by those skilled in the art that at different pressures the composition of a given azeotrope will vary, at least to some degree, and changes in pressure will also change, at least to some degree, the boiling point temperature. Thus an azeotrope of A, B and C represents a unique type of relationship but with a variable composition depending on temperature and/or pressure. Therefore compositional ranges, rather than fixed compositions, are often used to define azeotropes.

Or, the composition can be defined as a particular weight percent relationship or mole percent relationship of A, B and C, while recognizing that such specific values point out only one particular such relationship and that in actuality, a series of such relationships represented by A, B and C actually exist for a given azeotrope, varied by the influence of pressure.

Or, recognizing that the azeotrope A, B and C can be characterized by defining the composition as an azeotrope by a boiling point at a given pressure, thus giving identifying characteristics without unduly limiting the scope of the invention by a specific numerical composition, which is limited by and is only as accurate as the analytical equipment available.

Ternary mixtures of about 56 to about 66 weight percent CFC-113 and about 32 to about 40 weight percent trans-1,2-dichloroethylene and about 1 to about 9.5 weight percent cyclopentane are characterized as azeotropes or azeotrope-like in that mixtures within this range exhibit a substantially constant boiling point at constant pressure. Being substantially constant boiling, the mixtures do not tend to fractionate to any great extent upon evaporation or distillation. After evaporation or distillation, only a small difference exists between the composition of the vapor and the composition of the initial liquid phase. This difference is such that the compositions of the vapor and liquid phases are considered substantially identical. Accordingly, any mixture within this range exhibits properties which are characteristic of a true ternary azeotrope. The ternary composition consisting of about 60.7 weight percent CFC-113, about 36.2 weight percent trans-1,2-dichloroethylene and about 3.1 weight percent cyclopentane has been established, within the accuracy of the fractional distillation method, as a true ternary azeotrope, boiling at about 43.9° C., at substantially atmospheric pressure.

The azeotrope of the present invention permits easy recovery and reuse of the solvent from vapor defluxing and degreasing operations because of its azeotropic nature. As an example, the azeotropic mixture of this invention can be used in cleaning processes such as described in U.S. Pat. No. 3,881,949, which is incorporated herein by reference.

The azeotrope of the instant invention can be prepared by any convenient method including mixing or combining the desired component amounts. A preferred method is to weigh the desired component amounts and thereafter combine them in an appropriate container.

EXAMPLE 1

A solution containing 62.3 weight percent CFC-113, 34.7 weight percent trans-1,2-dichloroethylene and 3.0 weight percent cyclopentane was prepared in a suitable container and mixed thoroughly.

The solution was distilled in a Perkin-Elmer Model 251 Autoannular Spinning Band Still (200 plate fractionating capability using a 10:1 reflux to take-off ratio). Head and pot temperatures were read directly to 0.01° C. and 0.1° C., respectively. All temperatures were adjusted to 760 mm pressure. Distillate compositions were determined by gas chromatography. Results obtained are summarized in the following table:

DISTILLATION OF (62.3/34.7/3.0 wt. %) CFC-113/TRANS-1,2-DICHLOROETHYLENE (DCE)/CYCLOPENTANE

| Cuts | Temp. °C. Pot | Temp. °C. Head | Wt. % Distilled or Recovered | Composition (Wt. %) CFC-113 | trans-1,2-DCE | Cyclopentane |
|---|---|---|---|---|---|---|
| Foreshot | 44.7 | 43.91 | 12.0 | 59.96 | 35.27 | 4.77 |
| Cut 1 | 44.7 | 43.91 | 27.0 | 60.23 | 35.78 | 3.99 |
| Cut 2 | 44.7 | 43.93 | 40.6 | 60.47 | 35.96 | 3.57 |
| Cut 3 | 44.7 | 43.93 | 55.4 | 60.62 | 36.11 | 3.27 |
| Cut 4 | 44.7 | 43.97 | 69.6 | 60.86 | 36.34 | 2.80 |
| Cut 5 | 45.0 | 43.98 | 84.5 | 61.26 | 36.68 | 2.06 |
| Cut 6 | 45.3 | 43.98 | 88.3 | 61.68 | 36.89 | 1.43 |
| Heel | — | — | 98.1 | 73.19 | 26.17 | 0.64 |

Analysis of the above data indicates very small changes in both the boiling points and the distillate compositions as the distillation progressed. A statistical analysis of the data also indicates that the true ternary azeotrope of 1,1,2-trichloro-1,2,2-trifluoroethane, trans-1,2-dichloroethylene and cyclopentane has the following characteristics at atmospheric pressure (95 percent confidence limits):

1,1,2-Trichloro-1,2,2-trifluoroethane = 60.7 ± 1.0 wt.%
trans-1,2-Dichloroethylene = 36.2 ± 1.0 wt.%
cyclopentane = 3.1 ± 1.5 wt.%
Boiling point (°C. at 760 mm Hg) = 43.9 ± 0.1

EXAMPLE 2

A single sided circuit board was coated with activated rosin flux and soldered by passing the board over a preheater to obtain a top side board temperature of 200° F. and then through 500° F. molten solder. The soldered board was defluxed in an azeotropic mixture of 60.7 weight percent 1,1,2-trichloro-1,2,2-trifluoroethane, 36.2 weight percent trans-1,2-dichloroethylene and 3.1 weight percent cyclopentane (of Example 1) by first suspending it, for three minutes in the boiling azeotropic liquid, then, suspending it for one minute in the azeotropic vapor, above its boiling liquid. A careful examination of the thus cleaned circuit board showed no visible sign of any residue thereon.

We claim:

1. An azeotrope or azeotrope-like composition wherein the azeotrope or azeotrope-like components consist essentially of about 56 to about 66 weight percent 1,1,2-trichloro-1,2,2-triflouoroethane, about 32 to about 40 weight percent trans-1,2-dichloroethylene and about 1 to about 9.5 weight percent cyclopentane.

2. The azeotrope or azeotrope-like composition of claim 1 wherein the composition is about 60.7 weight percent 1,1,2-trichloro-1,2,2-trifluoroethane, about 36.2 weight percent trans-1,2-dichloroethylene and about 3.1 weight percent cyclopentane.

3. The azeotrope or azeotrope-like composition of claim 1 wherein the composition has a boiling point of about 43.9° C. at substantially atmospheric pressure.

4. A process for cleaning a solid surface which comprises treating said surface with the azeotrope or azeotrope-like composition of claim 1.

5. The process of claim 4 wherein the solid surface is a printed circuit board contaminated with flux and flux residues.

6. The process of claim 4 wherein the solid surface is a metal.

* * * * *